US005205250A

United States Patent [19]

Easterly et al.

[11] Patent Number: 5,205,250

[45] Date of Patent: Apr. 27, 1993

[54] FUEL PREHEATING SYSTEM

[75] Inventors: Herbert Easterly, Rte. 13, Box 66, Crossville, Tenn. 38555; Charlie F. Hunter, Cookeville, Tenn.

[73] Assignee: Herbert Easterly, Crossville, Tenn.

[21] Appl. No.: 802,749

[22] Filed: Dec. 6, 1991

[51] Int. Cl.[5] ..... F02N 17/02

[52] U.S. Cl. ..... 123/142.5 R; 123/557; 237/12.3 C

[58] Field of Search ..... 123/142.5, 557, 555; 237/12.3 C, 2 A; 126/110 B, 110 D; 122/136 R, 142

[56] References Cited

U.S. PATENT DOCUMENTS

| | | | |
|---|---|---|---|
| 3,450,109 | 6/1969 | Grantzmuller | 123/142.5 R |
| 4,192,457 | 3/1980 | Easterly | 237/12.3 C |
| 4,306,617 | 12/1981 | Lancaster | 123/557 |
| 4,320,734 | 3/1982 | Balachandran | 123/510 |
| 4,341,194 | 7/1982 | Wolters et al. | 123/555 |
| 4,348,992 | 9/1982 | Southard | 123/142.5 R |
| 4,377,149 | 3/1983 | Naylor et al. | 123/557 |
| 4,395,996 | 8/1983 | Davis | 123/557 |
| 4,397,287 | 8/1983 | Pierard | 123/557 |
| 4,406,270 | 9/1983 | Simonson, Sr. | 123/557 |
| 4,411,240 | 10/1983 | Kravetz | 123/142.5 R |
| 4,424,775 | 1/1984 | Mayfield, Jr. | 123/142.5 R |
| 4,454,851 | 6/1984 | Bourbonnaud et al. | 123/557 |
| 4,481,931 | 11/1984 | Bruner | 123/557 |
| 4,502,450 | 3/1985 | Duprez | 123/557 |
| 4,502,451 | 3/1985 | Duprez | 123/557 |
| 4,512,882 | 4/1985 | Fischer et al. | 210/86 |
| 4,553,697 | 11/1985 | Nothen | 123/557 |
| 4,590,888 | 5/1986 | Mosig | 237/12.3 C |
| 4,612,897 | 9/1986 | Davis | 123/557 |
| 4,629,560 | 12/1986 | Harris | 123/557 |
| 4,650,576 | 3/1987 | Leary et al. | 123/557 |
| 4,656,979 | 4/1987 | Hogenson | 123/557 |
| 4,664,088 | 5/1987 | Cantoni | 123/557 |
| 4,926,830 | 5/1990 | McNelley | 123/142.5 R |
| 4,933,093 | 6/1990 | Keller | 123/557 |
| 5,048,752 | 9/1991 | Hintennach | 123/142.5 R |

FOREIGN PATENT DOCUMENTS

| | | | |
|---|---|---|---|
| 3208828 | 9/1983 | Fed. Rep. of Germany | 237/12.3 C |

OTHER PUBLICATIONS

Thermo Star Bulletin No. 3377585.
Espar Products, Inc. brochure.
Webasto Heater, Inc. brochure.
Alltec Heaters Inc. brochure.

*Primary Examiner*—E. Rollins Cross
*Assistant Examiner*—Erick Solis
*Attorney, Agent, or Firm*—Barnes & Thornburg

[57] ABSTRACT

An apparatus is provided for preheating fuel from a vehicle fuel tank prior to feeding the fuel to a vehicle engine. The apparatus comprises first and second heat exchangers. The first heat exchanger uses fuel from the fuel tank to heat engine coolant received from the vehicle engine. The second heat exchanger uses engine coolant to discharge from the first heat exchanger to heat the fuel received from the fuel tank.

10 Claims, 2 Drawing Sheets

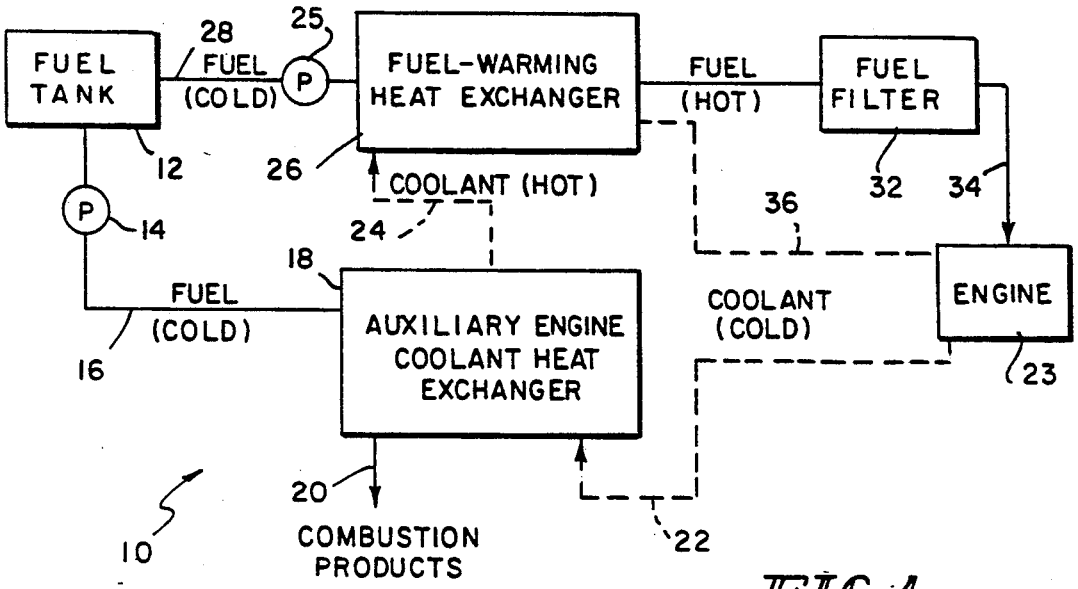
FIG. 1
FIG. 2
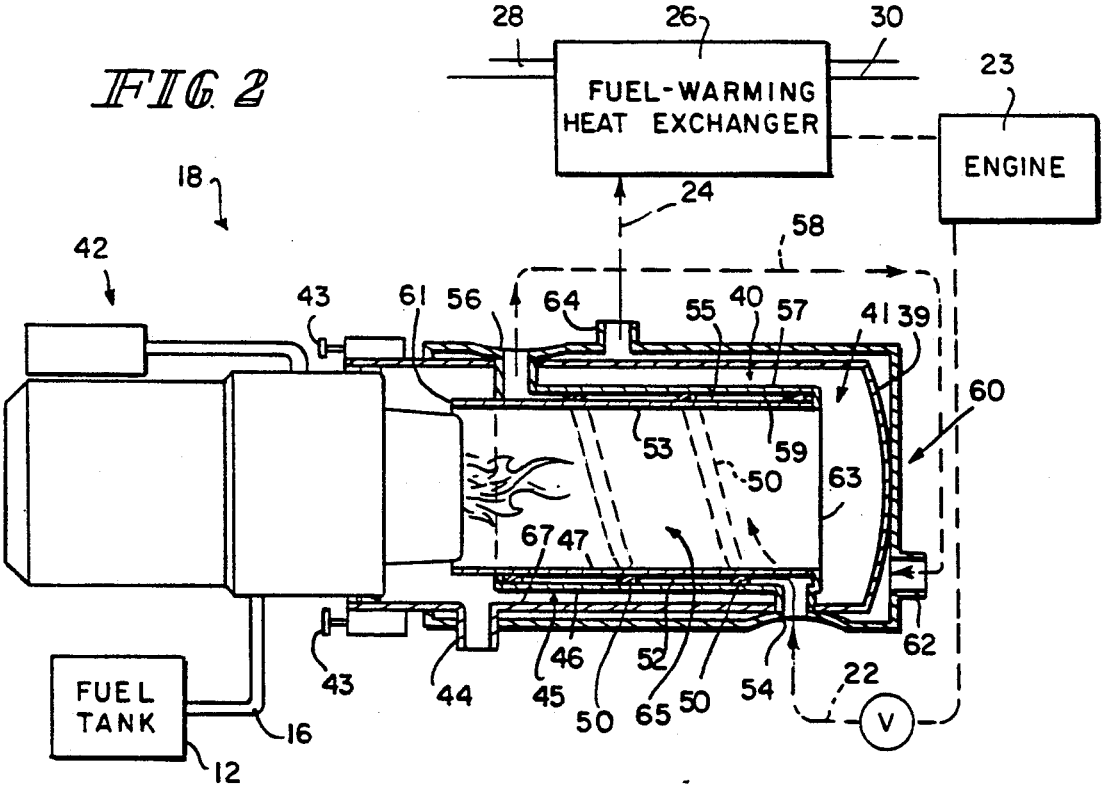

FUEL PREHEATING SYSTEM

BACKGROUND AND SUMMARY OF THE INVENTION

The present invention relates to a fuel preheater system. More particularly, the present invention relates to a system which heats engine coolant and uses the engine coolant to heat fuel prior to combustion of the fuel in a vehicle engine.

Vehicles using diesel fuel have long experienced fuel systems problems during cold weather operation. At sufficiently low temperatures, diesel fuel becomes undesirably viscous, a condition which is exacerbated by the formation of wax crystals in the fuel. Cold diesel fuel thus may clog a fuel filter, possibly interrupting the operation of the vehicle or preventing starting.

It is therefore desirable to provide a system for preheating fuel prior to its introduction to a fuel filter. Such a system must be sized for easy installation on a vehicle and must be rugged enough to withstand the jarring and vibration typically encountered during vehicle operation.

It has been recognized that a fuel preheater system preferably makes use of fluids already circulating in the vehicle engine as opposed to auxiliary fuel supplies for use as the working fluid for heating the fuel. Preheater systems operating on auxiliary fuel supplies such as propane gas or butane gas pose unacceptable risks of explosion. Conveniently, a portion of the fuel itself might be used to provide heat to the main supply of fuel. Alternatively, the engine coolant might be used.

According to the present invention, an apparatus is provided for preheating fuel from a vehicle fuel tank prior to feeding the fuel to a vehicle engine. The apparatus comprises first heat exchange means for using fuel from the fuel tank to heat engine coolant received from the vehicle engine, and second heat exchange means for using engine coolant discharged from the first heat exchange means to heat fuel received from the fuel tank. The first heat exchange means includes means for burning fuel received from the fuel tank to form a combustion product stream. The first heat exchange means also includes first passageway means for passing engine coolant in counterflow heat exchange relationship with a combustion product stream to heat the engine coolant to a predetermined temperature.

The present invention also relates to a method for preheating fuel from a vehicle fuel tank for feeding to a vehicle engine. The method comprises the steps of feeding a first portion of the fuel from the fuel tank to a first heat exchanger, and burning the portion of fuel in the first exchanger to form a combustion product stream. The method further comprises the steps of feeding a first stream of engine coolant from the vehicle engine to the first heat exchanger, passing the combustion products stream in heat exchange relationship with the first engine coolant stream in the first heat exchanger to heat the engine coolant stream to a predetermined temperature to form a heated engine coolant stream, and feeding a second portion of fuel from the fuel tank to the second heat exchanger. The method further comprises the steps of feeding the heated engine coolant stream to the second heat exchanger and passing the second portion of fuel in heat exchange relationship with a heated engine coolant stream in the second heat exchanger to heat the second portion of fuel to a predetermined temperature.

Advantageously, the present system makes use of both engine coolant and a portion of the fuel itself to provide heat exchange in a pair of cooperating heat exchangers.

Further advantageously, the system can optionally include a heat exchanger which can be easily rendered inoperable by a user, for example, in warm weather conditions.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 1 is a schematic representation of a fuel preheating system in accordance with the present invention showing a fuel-warming heat exchanger connected to an auxiliary heat exchanger;

FIG. 2 is a side view, with parts cross-sectioned, of an auxiliary heat exchanger in accordance with the present invention showing the flow paths of engine coolant and combusted fuel as they pass in dual-pass, counterflow heat exchange relationship;

DETAILED DESCRIPTION OF THE DRAWINGS

Figures 3, 4:
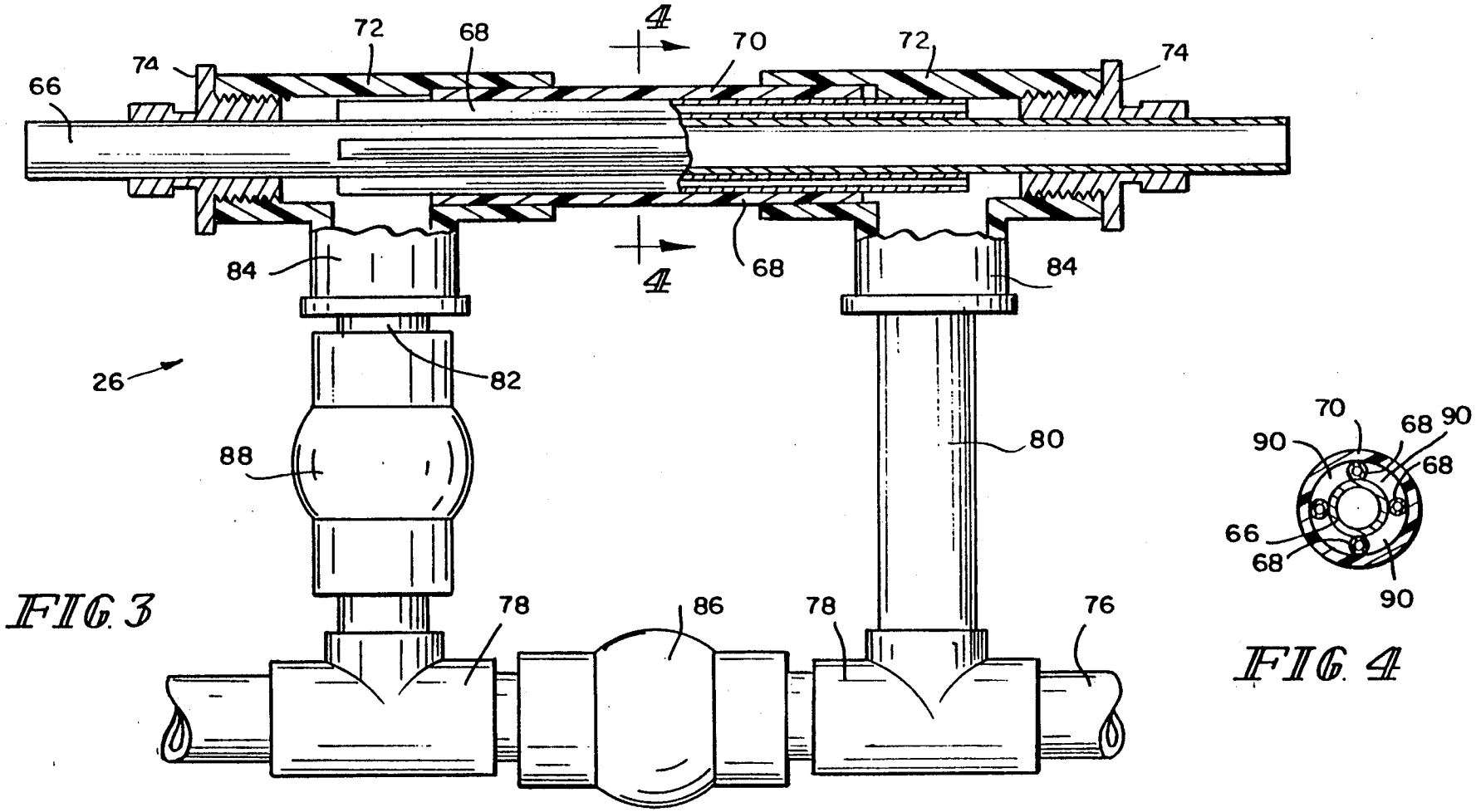
FIG. 3 is a plan view, partially cross-sectioned, of a fuel-warming heat exchanger including a bypass valving arrangement.
FIG. 4 is a partial end sectional view of the fuel-warming exchanger of FIG. 3 showing a fuel flow line surrounded by a plurality of tubes providing a flow area for the engine coolant.

A fuel preheating system 10 in accordance with the present invention is illustrated schematically in FIG. 1. System 10 is particularly adapted for use in vehicle fuel systems using diesel fuel. System 10 provides a pump 14 for drawing a predetermined portion of cold fuel from a fuel tank 12. Pump 14 pumps the portion of fuel (designated as stream 16 in FIG. 1) to an auxiliary engine coolant heat exchanger 18. The flow rate of fuel along stream 16 is typically in the range of 0.4 g.p.h. to 0.6 g.p.h., and the temperature of such fuel (at the outlet side of pump 14) is typically about 50° F. to about 60° F.

As will be subsequently described in greater detail, heat exchanger 18 heats incoming engine coolant and discharges the hot coolant to a fuel-warming heat exchanger 26. To heat incoming engine coolant, heat exchanger 18 takes in a predetermined portion of fuel 16 and ignites it to form a stream of combustion products. For clarity, fuel flow lines (e.g. that which carries fuel 16) are shown in solid lines, while engine coolant lines (e.g. that which carries engine coolant 22) are shown in dotted lines in FIGS. 1 and 2.

Engine coolant 22 is received in heat exchanger 18 from engine 23 and passes in heat exchange relationship with the stream of combustion products. Engine coolant enters at temperatures in the range of about 65° F. to about 75° F. and at flow rates of about 6 g.p.m. to about 8 g.p.m. After the heat exchange, the now-hot coolant is discharged as a stream 24. Temperatures of about 165° F. to about 185° F. (after a time of about twenty minutes) are typical for stream 24. The combustion products are discharged as stream 20.

Fuel-warming heat exchanger 26 receives hot coolant stream 24 as well as a cold fuel stream 28. A vehicle fuel pump 25 or the like is used to pump fuel from tank 12 to fuel-warming heat exchanger 26 along stream 28. It will be understood by those of ordinary skill in the art that the location of fuel pump 25 may be changed without varying its function. The temperature of fuel in fuel stream 28 will vary according to the conditions under which the vehicle operates.

Fuel-warming heat exchanger 26 is preferably a concentric tube, parallel flow heat exchanger, although counterflow or shell and tube heat exchangers might also be used. Cold fuel from stream 28 is passed in heat exchange relationship with hot coolant from stream 24. Warmed fuel is discharged as stream 30 to a fuel filter 32 and eventually to engine 23. Advantageously, fuel in stream 30 can be heated to temperatures of about 110° F. to about 120° F. at fuel flow rates of about 8 g.p.h in a time of about nine minutes. The coolant stream is discharged to engine 23 as a stream 36. The temperature of stream 36 is about 175° F. to about 185° F.

Referring to FIG. 2, heat exchanger 18 is shown in greater detail. Heat exchanger 18 includes a cylindrical shell or housing 40 defining an interior region 41. Heat exchange between combustion products of fuel 16 and engine coolant from engine 23 occurs in interior region 41.

A burner assembly 42 is attached to one end of housing 40 by way of bolts 43 or the like. Burner assembly 42 provides means for burning a predetermined portion of fuel received from fuel tank 12 as stream 16 to form a combustion product stream. Burner assembly 42 may be any one of a variety of commercially-available burner units adapted to receive fuel and ignite it in a typical ignition apparatus to form the stream of combustion products which flows through interior region 41.

Housing 40 is formed to include an outlet port 44 providing means for discharging the stream of combustion products. Outlet port 44 is located in relatively close proximity to burner assembly 42 so that the stream of combustion products flows to end 39 of housing 40, then reverses itself to flow back toward burner assembly 42 to reach outlet port 44.

Located in interior region 41 of housing 40 is an assembly 45 providing passageway means for guiding engine coolant through interior region 41. In addition to providing a helical or first flow path for guiding engine coolant through interior region 41 of housing 40, assembly 45 provides a dual-pass or second flow path for guiding the combustion products stream through interior region 41 toward end 39 of housing 40 and back toward outlet port 44 in dual-pass heat exchange relationship with the engine coolant stream.

Assembly 45 includes an outer cylinder 46 and an inner cylinder 47 coaxial with outer cylinder 46 and spaced apart about a quarter of an inch therefrom to define an annular space 52 therebetween. Outer cylinder 46 is provided with an inlet port 54 extending through a wall of housing 40 and positioned to receive engine coolant from stream 22 and convey the engine coolant to annular space 52. Likewise, outer cylinder 46 is provided with an outlet port 56 extending through a wall of housing 40. Engine coolant which has flowed through annular space 52 exits through outlet port 56.

Inner cylinder 47 includes an inner surface 53 providing a first heat exchange surface as will subsequently be described and an outer surface 55. Outer cylinder 46 includes an outer surface 57 likewise providing a second heat exchange surface and an inner surface 59. A helical wall member 50 is positioned in annular space 52 to define the helical or first flow path. Helical member 50 is welded to inner surface of outer cylinder 46. Helical member 50 is of a dimension so as to span annular space 52 such that inner cylinder 47 lies in tight fitting engagement with helical member 50.

Inner cylinder 47 and outer cylinder 46 are welded together at the ends 61, 63 thereof so that annular space 52 is fully enclosed. Thus, engine coolant received from port 54 forms a sheet which flows about outer surface of inner cylinder 47 in annular space 52, guided by helical wall member 50.

The dual-pass or second flow path for the combustion products stream extends along inner surface 53 of inner cylinder 47 and along outer surface 57 of outer cylinder 46. That is, the combustion products stream flows in a region 65 defined by inner surface 53 of inner cylinder 47 and progresses toward end 39 of housing 40.

Particularly, inner surface 53 of inner cylinder 47 defines a first portion of the dual-pass or second flow path. The combustion products stream contacts inner surface 53 and exchanges heat with engine coolant flowing in annular space 52 along the helical flow path in counterflow relationship with the combustion products stream. Inner surface 53 thus provides a first heat exchange surface for heat exchange between the combustion products stream and the engine coolant stream.

Outer surface 57 of outer cylinder 46 cooperates with an inner surface 67 of housing 40 to define a second portion of the dual-pass flow path. The combustion products stream in the second portion of the dual-pass flow path flows toward discharge port 44—that is, in the direction opposite to the flow in the first portion of the dual-pass flow path. Heat exchange occurs between the combustion products stream flowing along outer surface 57 of outer cylinder 46 and the engine coolant stream flowing in annular space 52 along the helical or first flow path. At this point, the combustion products stream and the engine coolant stream are flowing in parallel relationship. Thus, the outer surface 57 of outer cylinder 46 provides a second surface for heat exchange. The exchanger may thus be characterized as a dual-pass heat exchanger.

Heat exchanger 18 also includes a jacket 60 for minimizing heat loss from housing 40. Jacket 60 surrounds housing 40 along substantially the entire axial length thereof, providing an insulation blanket. Jacket 60 is itself insulated or alternatively, is fabricated from material which minimizes heat loss therefrom. Jacket 60 is provided with an inlet port 62 for receiving coolant from a recycle stream 58 and an outlet port 64 for discharging coolant to stream 24, from which it enters fuel-warming heat exchanger 26 as indicated.

Fuel-warming heat exchanger 26 is preferably a concentric pipe, parallel flow heat exchanger including a first pipe providing a flow path for fuel and a second pipe providing a flow path for engine coolant. Fuel-warming heat exchanger 26 is shown in FIGS. 3 and 4. Fuel received from stream 28, as shown in FIGS. 1 and 2, flows through fuel pipe 66, which is preferably a copper tube of about 0.5 inch inner diameter. Four copper tubes 68 are soldered at equal intervals about the circumference of fuel pipe 66, as shown, e.g., in cross-section in FIG. 4. Copper tubes 68 are preferably about 0.1 inch inner diameter.

Fuel pipe 66 and tubes 68 extend into a one-inch PVC pipe 70. A pair of one-inch tees 72 is glued to pipe 70.

Threaded step-down adapters 74 hold fuel pipe 66 in place in tees 72 and PVC pipe 70.

A PVC pipe 76, preferably of 0.75 inch diameter, is provided for flow of engine coolant received from stream 24 (as shown in FIGS. 1 and 2). A pair of 0.75 inch tees 78 is glued to pipe 76. PVC pipes 80 and 82 extend between tees 78 and tees 72 to allow coolant to flow from pipe 76 to pipe 70 to provide fuel-warming heat exchange. A pair of step-down adapters 84 is provided between each tee 72 and PVC pipes 80, 82 respectively.

A PVC inline valve 86, preferably 0.75 inch, is provided in pipe 76 intermediate tees 78. Another PVC inline valve 88, also preferably 0.75 inch, is provided in pipe 82. Those of ordinary skill in the art will appreciate that a variety of standard, commercially-available valves can be used.

Fuel-warming heat exchanger 26 can be operated in either a fuel-warming mode or a bypass mode depending upon the valving arrangement chosen by the user for valves 86, 88. For operation in the fuel-warming mode, valve 86 is closed and valve 88 is open. Closure of valve 86 forces coolant in pipe 76 to enter pipe 82 and to pass through open valve 88 into one of tees 72.

Some of the coolant flows into tubes 68 which surround fuel pipe 66. However, most of the coolant flows into areas 90 defined between PVC pipe 70, fuel pipe 66, and tubes 68. Advantageously, tubes 68 act as fins, providing greater surface area for heat exchange between the coolant stream flowing in areas 90 and the fuel stream flowing in fuel pipe 66.

At the completion of fuel-warming heat exchange, coolant exits areas 90 (and tubes 68) at another of tees 72, from which the coolant passes into PVC pipe 80. Coolant can then flow back into pipe 76 by way of tee 78, eventually reaching stream 36 (shown in FIGS. 1 and 2).

In operation in the bypass mode, closed valve 88 prevents coolant in pipe 76 from flowing through pipe 82. Instead, coolant continues to flow in pipe 76 through open valve 86. Thus, in the bypass mode, fuel-warming heat exchanger 26 is selectively disabled so that no heat exchange occurs between incoming fuel in fuel pipe 66 and engine coolant in pipe 72. Advantageously, then, fuel preheating system 10 can be shut off for operation under temperate conditions where no fuel warming is necessary.

The operation of heat exchanger 18 can be summarized as follows. Fuel from fuel tank 12 enters burner assembly 42, where the fuel is burned to form a stream of combustion products. The combustion products enter the first portion of dual-pass flow path 48 defined by inner surface 53 of inner cylinder 47.

Meanwhile, engine coolant stream 22 enters inlet port 54 and passes toward outlet port 56 along the helical flow path defined in annular space 52 by wall member 50. The engine coolant is at this point in counterflow heat exchange relationship with the combustion products stream. When the combustion products stream reaches end 39 of housing 40, it reverses flow and flows along outer surface 57 of outer cylinder 46 in parallel to engine coolant flowing in annular space 52 along the helical flow path.

Upon exiting outlet port 56, the now-hot engine coolant enters recycle stream 58, passing to inlet port 62 of jacket 60. In jacket 60, the engine coolant flows toward outlet port 64, providing a barrier to heat which might otherwise escape from the outer surface of housing 40.

Once it exits outlet port 64 as stream 24, the engine coolant passes to fuel-warming heat exchanger 26, where it flows in parallel heat exchange relationship to fuel received therein from fuel tank 12. Fuel from fuel tank 12 is warmed as has been described above before passing to fuel filter 32 or the like.

Although the invention has been described in detail with reference to certain preferred embodiments, variations and modifications exist within the scope and spirit of the invention as described and defined in the following claims.

What is claimed is:

1. An apparatus for preheating fuel from a vehicle fuel tank prior to feeding the fuel to a vehicle engine, the apparatus comprising first heat exchange means for using fuel from the fuel tank to heat engine coolant received from the vehicle engine, the first heat exchange means including means for burning fuel received from the fuel tank to form a combustion products stream and first passageway means for passing engine coolant in counterflow heat exchange relationship with the combustion products stream to heat the engine coolant to a predetermined temperature, the first passageway means including an outer cylinder, an inner cylinder positioned in spaced-apart, coaxial relationship with the outer cylinder so as to define an annular space therebetween, the inner cylinder including an inner wall providing an inner heat exchange surface, the outer cylinder including an outer wall providing an outer heat exchange surface, the inner and outer cylinders cooperating to define a flow path for the combustion products stream in the interior region so that the combustion products stream passes along the inner heat exchange surface and the outer heat exchange surface to reach the discharge means, and means for guiding the engine coolant through the annular space along a helical path, the guide means being positioned in the annular space, and second heat exchange means for using engine coolant discharged from the first heat exchange means to heat fuel received from the fuel tank.

2. An apparatus for preheating fuel from a vehicle fuel tank prior to feeding the fuel to a vehicle engine, the apparatus comprising first heat exchange means for using fuel from the fuel tank to heat engine coolant received from the vehicle engine, the first heat exchange means including means for burning fuel received from the fuel tank to form a combustion products stream, first passageway means for passing engine coolant in counterflow heat exchange relationship with the combustion products stream to heat the engine coolant to a predetermined temperature, said first heat exchange means including a housing appended to the burner means and second passageway means surrounding the housing for passing heated engine coolant about the periphery of the housing so that heat loss from the housing is minimized, the second passageway means including an inlet positioned to receive heated engine coolant from the first passageway means and an outlet to discharge heated engine coolant to the second heat exchange means, and second heat exchange means for using engine coolant discharged from the first heat exchange means to heat fuel received from the fuel tank.

3. In combination with a fuel-warming heat exchanger including a first flow path for the passage of fuel to be warmed and a second flow path for the passage of engine coolant to transfer heat to fuel passing through the first flow path, a heat exchanger comprising a housing defining an interior flow chamber and including means for discharging combustion products from the interior flow chamber, means for burning fuel to produce a stream of combustion products for passage through the interior flow chamber to the discharge means, first passageway means for guiding coolant received from the engine through the interior flow chamber in counterflow heat exchange relationship with the combustion products stream in the interior flow chamber, the first passageway means extending into the interior flow chamber, and second passageway means for guiding coolant received from the first passageway means about the periphery of the housing to minimize heat loss from the housing, the second passageway means including means for discharging heated engine coolant to the fuel-warming heat exchanger to enter the second flow path thereof to heat fuel flowing in the first flow path.

4. The heat exchanger of claim 3, wherein the first passageway means is formed to include a first flow path for the engine coolant and a second flow path for the combustion products stream.

5. The heat exchanger of claim 4, wherein the first flow path is helical and the second flow path is linear.

6. The heat exchanger of claim 3, wherein the first passageway means includes an outer cylinder, an inner cylinder positioned in spaced-apart coaxial relationship with the outer cylinder to define an annular space therebetween, and a helical guide member extending between the inner cylinder and the outer cylinder to define a helical guide path for the engine coolant.

7. The heat exchanger of claim 6, wherein the first passageway means includes a first end positioned adjacent the burner means, a second end opposite the first end, and an interior flow path defined by the inner cylinder, the first passageway means being positioned so that the combustion products stream flows from the first end to the second end while the engine coolant flows through the annular space from the second end to the first end in counterflow relationship to the combustion products stream.

8. The heat exchanger of claim 6, wherein the inner cylinder includes an inner wall providing an inner heat exchange surface and the outer cylinder includes an outer wall providing an outer heat exchange surface, and the inner and outer cylinders cooperate to define a flow path for the combustion products stream in the interior flow chamber so that the combustion products stream passes along the inner heat exchange surface and the outer heat exchange surface to reach the discharge means.

9. A method for preheating fuel from a vehicle fuel tank for feeding to a vehicle fuel engine, the method comprising the steps of feeding a first portion of fuel from the fuel tank to a first heat exchanger, the first heat exchanger including passageway means for guiding the engine coolant, the passageway means including an inner heat exchange surface and an outer heat exchange surface, burning the portion of fuel in the first heat exchanger to form a combustion products stream, feeding a first stream of engine coolant from the vehicle engine to the first heat exchanger, passing the combustion products stream along both the inner and outer heat exchange surface to heat the first engine coolant stream to a predetermined temperature to form a heated engine coolant stream, feeding a second portion of fuel from the fuel tank to a second heat exchanger, feeding the heated engine coolant stream to the second heat exchanger, and passing the second portion of fuel in heat exchange relationship with the heated engine coolant stream in the second heat exchanger to heat the second portion of fuel to a predetermined temperature.

10. A method for preheating fuel from a vehicle fuel tank for feeding to a vehicle engine, the method comprising the steps of feeding a first portion of fuel from the fuel tank to a first heat exchanger, the first heat exchanger being provided with a jacket burning the portion of fuel in the first heat exchanger to form a combustion products stream, feeding a first stream of engine coolant from the vehicle engine to the first heat exchanger, passing the combustion products stream in heat exchange relationship with the first engine coolant stream in the first heat exchanger to heat the engine coolant stream to a predetermined temperature to form a heated engine coolant stream, feeding a second portion of fuel from the fuel tank to a second heat exchanger, feeding the heated engine coolant stream to the second heat exchanger, and passing the second portion of fuel in heat exchange relationship with the heated engine coolant stream in the second heat exchanger to heat the second portion of fuel to a predetermined temperature, recycling the heated engine coolant stream for passage through the jacket to minimize heat loss from the first heat exchanger.

* * * * *